United States Patent [19]

Chiang

[11] Patent Number: 5,044,242

[45] Date of Patent: Sep. 3, 1991

[54] CUTTER SHAFT OF PERFORATOR

[76] Inventor: Tom Chiang, No. 87, Kung Yeh Rd., Ind'l District, Tou Liu City, Yun Lin Hsien, Taiwan

[21] Appl. No.: 522,102

[22] Filed: May 11, 1990

[51] Int. Cl.[5] ..... B26D 5/10; B26F 1/04

[52] U.S. Cl. ..... 83/549; 83/571; 83/588; 83/622

[58] Field of Search ..... 83/549, 550, 551, 571, 83/582, 588, 620, 622, 660, 687, 688, 691

[56] References Cited

U.S. PATENT DOCUMENTS

| | | | |
|---|---|---|---|
| 2,957,380 | 10/1960 | Duncan et al. | 83/571 X |
| 3,227,023 | 1/1966 | Bouvier | 83/622 X |
| 4,611,520 | 9/1986 | Terracciano | 83/549 |
| 4,645,399 | 2/1987 | Scharer | 83/622 X |

*Primary Examiner*—Frank T. Yost
*Assistant Examiner*—Eugenia A. Jones
*Attorney, Agent, or Firm*—Morton J. Rosenberg

[57] ABSTRACT

An improved cutter system having a plurality of cutters with inclined cutting edges which are alternately inclined to provide a cleaner cut of paper or other material.

2 Claims, 7 Drawing Sheets

CUTTER SHAFT OF PERFORATOR

BACKGROUND OF THE INVENTION

The present invention relates to a cutter system, and more particularly to a cutter system with the cutting edges of the cutters alternately inclined to provide a cleaner cut of paper or other materials in prior art cutters.

Most of the known cutter systems do not use cutters with inclined cutting edges. Those known cutter systems that do use cutters with inclined cutting edges have the inclined cutting edges arranged in the same direction. Furthermore, known cutter systems do not directly couple the spring means and the pressure levers which contact the cutters. It is an improvement to arrange the cutting edges of adjacent cutters in alternate directions. Another improvement is to directly couple the spring means and the pressure levers which engage the cutters, thereby requiring a smaller force to return the cutter system to its original position subsequent to cutting.

SUMMARY OF THE INVENTION

It is the purpose of this invention to mitigate and/or obviate the above-referenced drawbacks in the manner set forth in the Detailed Descriptions of the Drawings.

A primary purpose of this invention is to provide an improved cutter system which provides cleaner ones to paper and other materials.

Further objectives and advantages of the present invention will become apparent as the following description proceeds, and the features of novelty are characterized in the Claims annexed hereto and forming a part of this invention.

DETAILED DESCRIPTION OF THE PREFERRED EMBODIMENT

Figure 1:
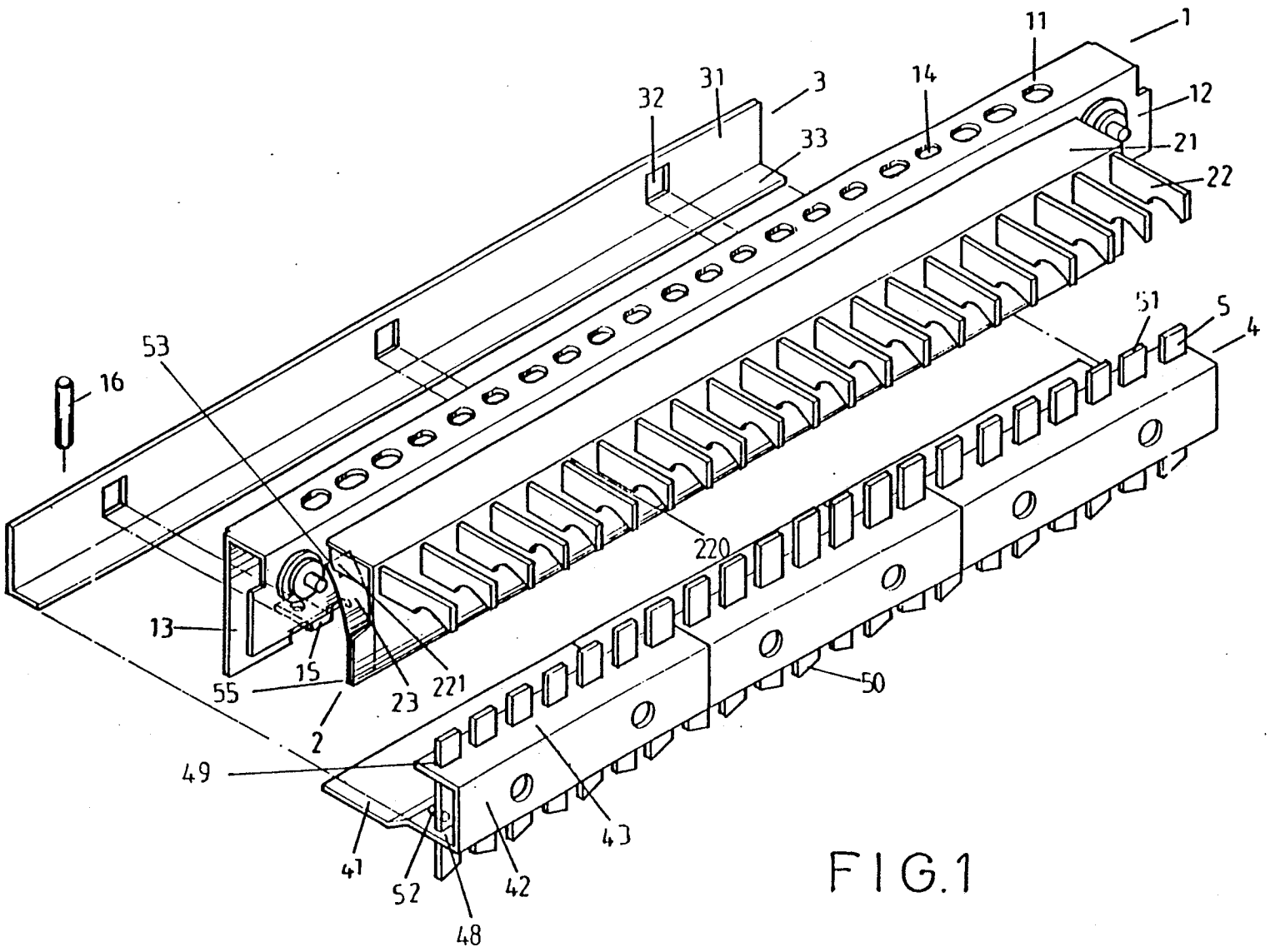
FIG. 1 is an exploded view of the present invention.
Figure 2:
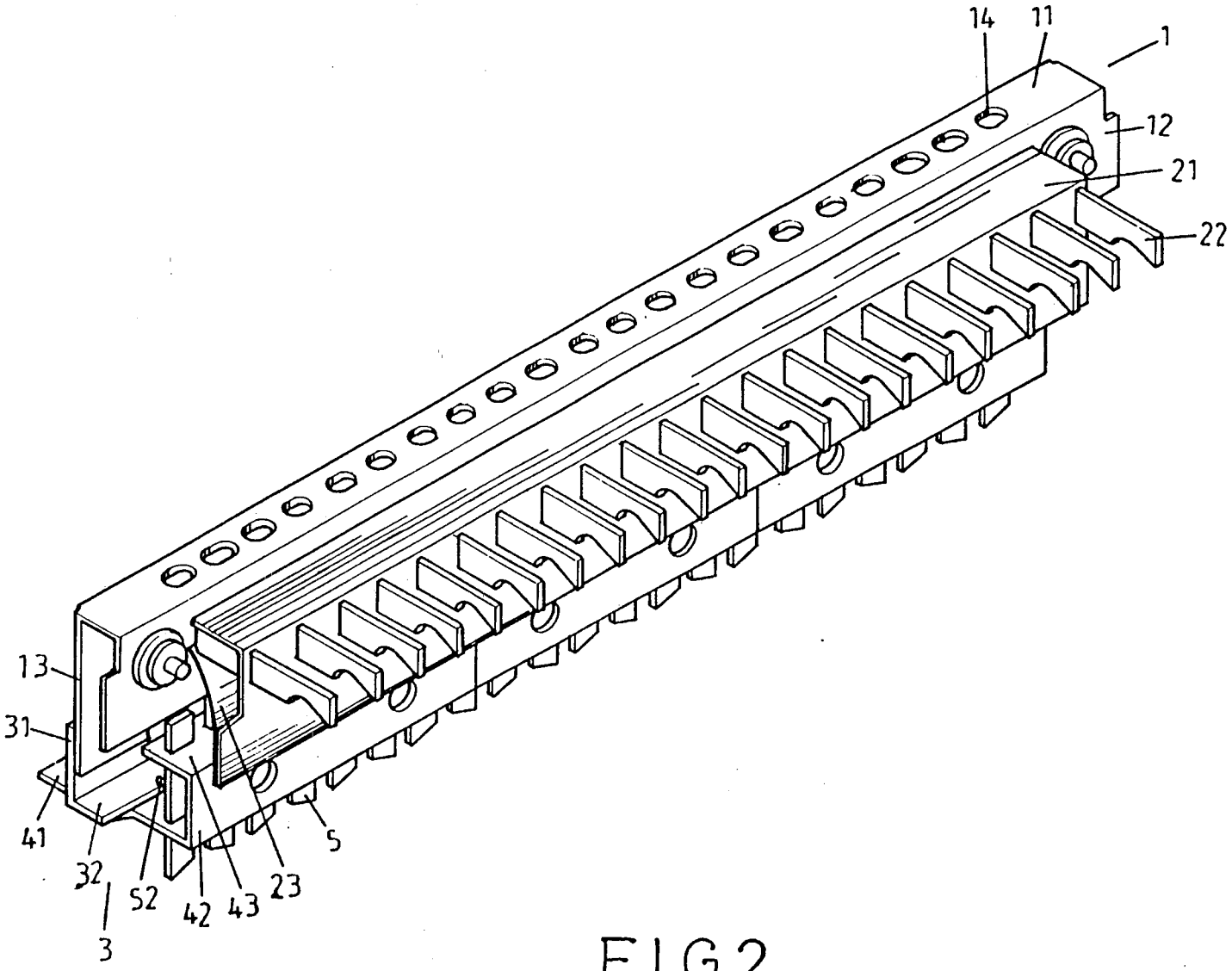
FIG. 2 is a perspective view of the present invention.
Figure 3:
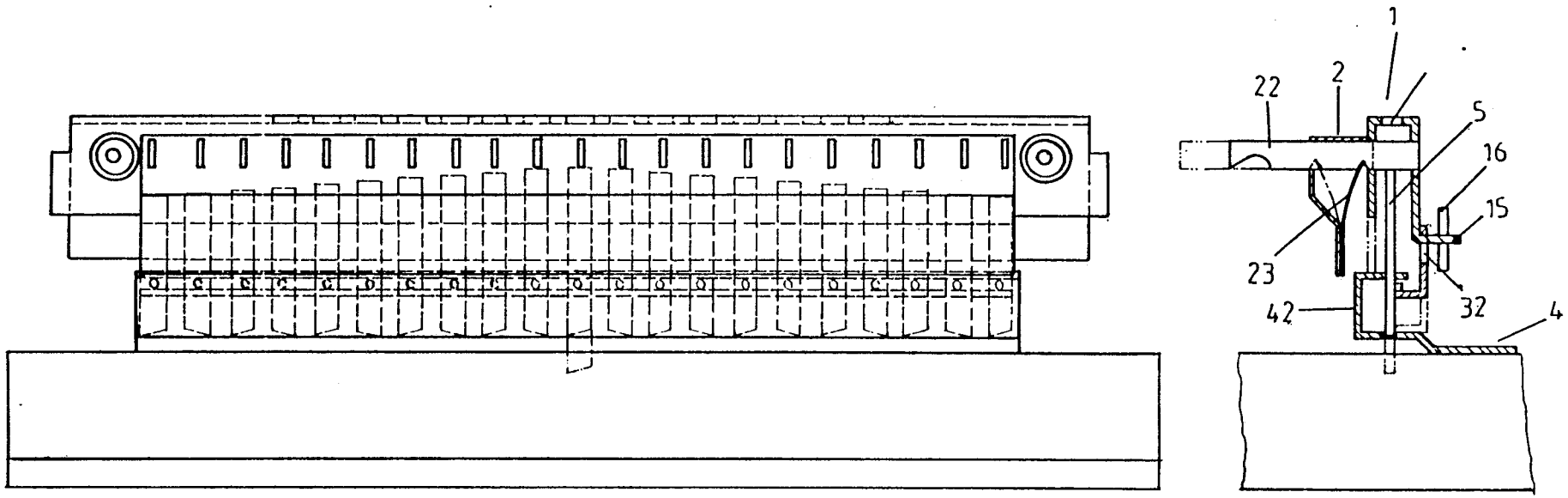
FIG. 3A is a front perspective view of the present invention.
FIG. 3B is a side cross-sectional view of the present invention.
Figure 4:
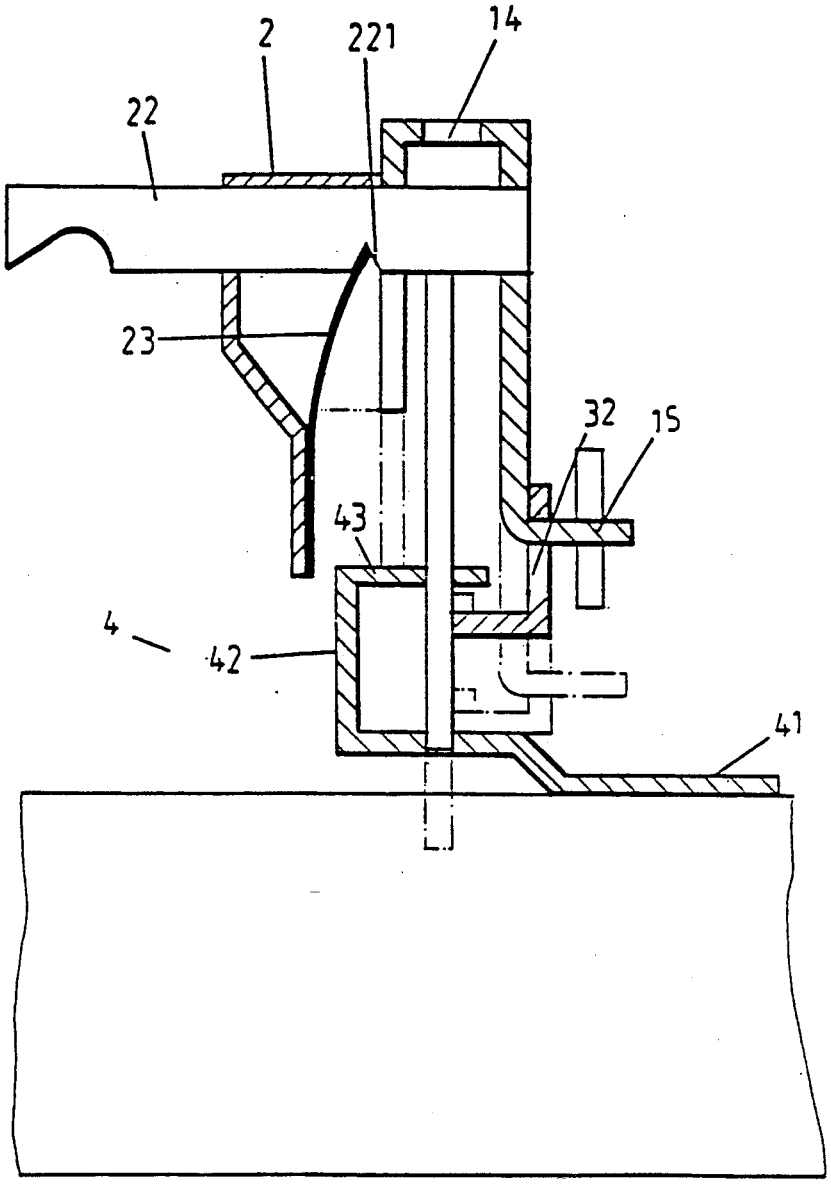
FIG. 4 is an enlarged view of the FIG. 3B with the cutters in the raised position.
Figure 5:
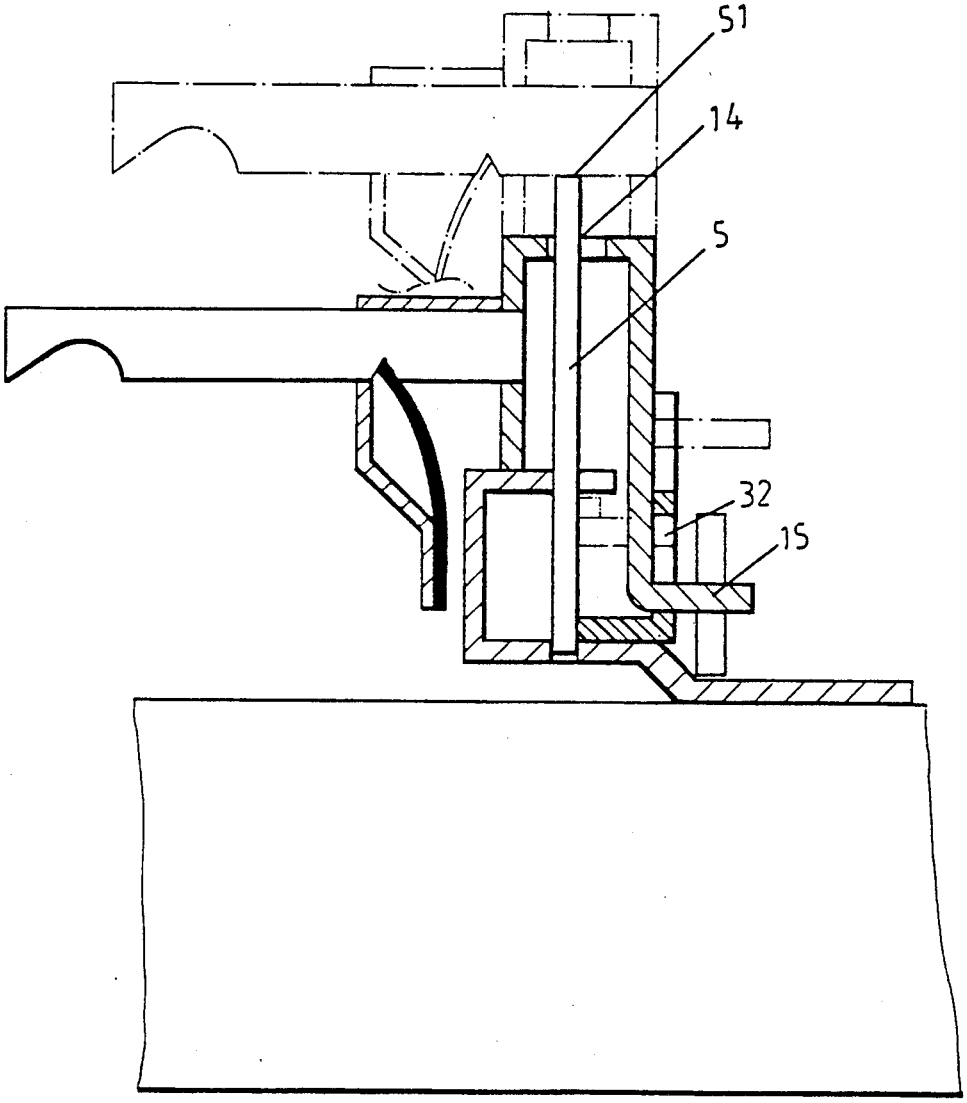
FIG. 5 is another enlarged view of the FIG. 3B with the cutters pressed down.
Figures 6A, 6B:
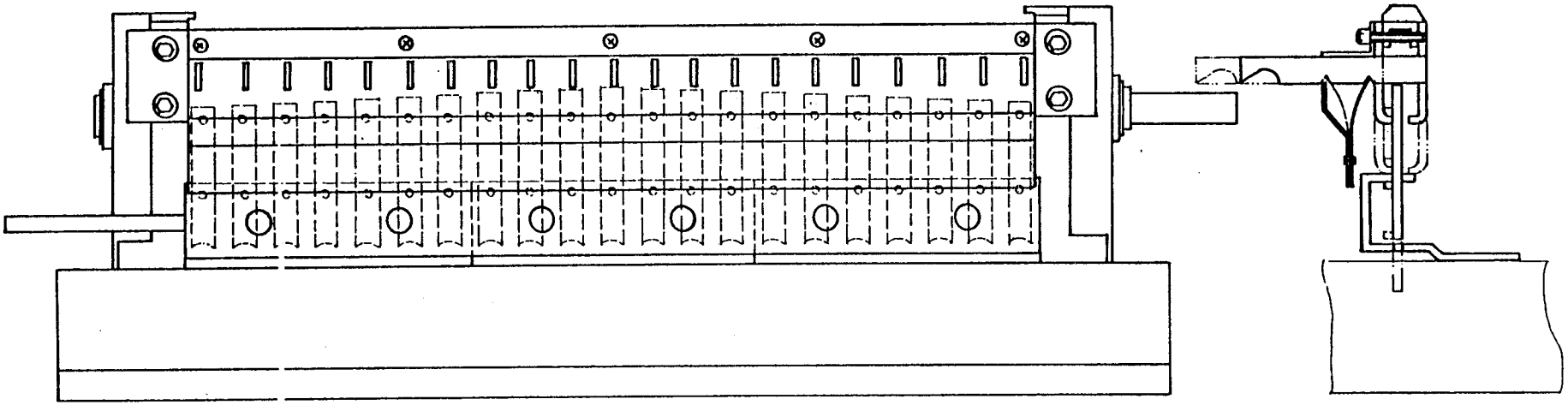
FIGS. 6A and 6B are prior art cutters.
Figures 7A, 7B:
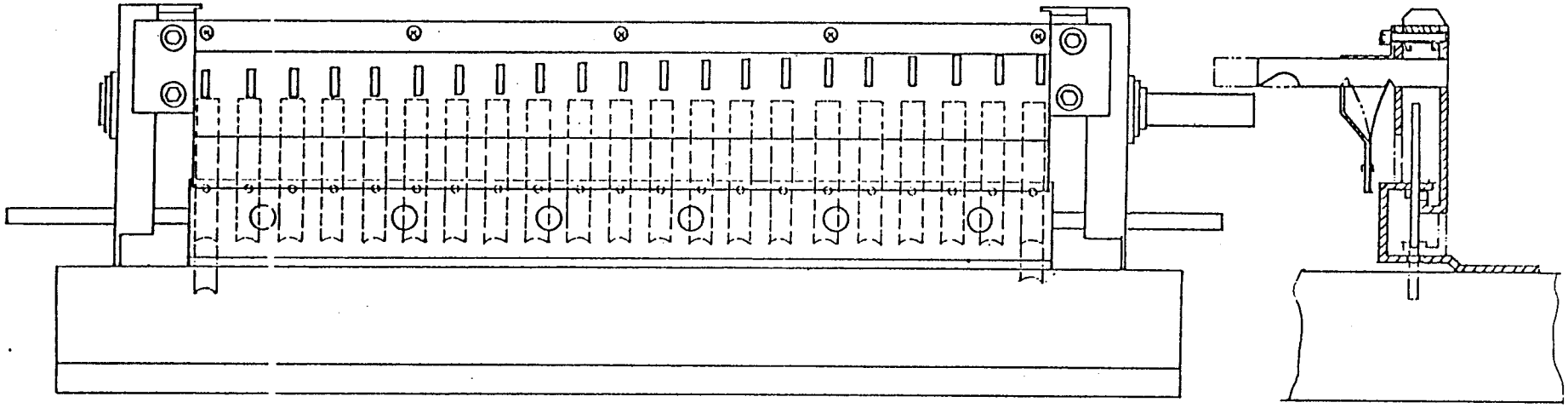
FIGS. 7A and 7B are prior art cutters.

Now referring to FIGS. 1–5, it can be seen that the present invention comprises a pressure shaft 1, a press bar 2, a L-shaped lever 3, a cutter mounting 4 and a plurality of cutters 5, each of which has an inclined cutting edge 50. The pressure shaft 1 includes a horizontal surface 11, a first vertical surface 12 and a second vertical surface 13. The horizontal surface 11 has a plurality of openings 14 therethrough. The second vertical surface 13 has a plurality of lug members 15 extending rearwardly from its bottom edge. A plurality of pressure levers 22 are fixedly attached to and extend forwardly from the first vertical surface 12. The press bar 2 is shaped like a numeral 7 and has a plurality of spring plates 23, each of which has a first end 55 fixedly attached to a mounting 21 of the press bar. The pressure levers 22 extend through the upper end of a vertical surface 220 of press bar 2. Each spring plate 23 has a second end 53 engaged within a trough 221 of a corresponding pressure lever 22. The 'L' shaped lever 3 has a horizontal surface 33 and a vertical surface 31 which has several openings 32 that receive the lug members 15 of the second vertical surface 13 of the pressure shaft 1. The cutter mounting 4 includes a twist plate 41, a vertical surface 42 and a horizontal surface 43. The twist plate 41 and the horizontal surface 43 have a plurality of openings 48 and 49, respectively, passing therethrough in a one-to-one relationship. The cutters 5 extend through the openings in the twist plate 41 and the horizontal surface 43. The lengths of the cutters 5 are different from one another. Each cutter has a protuberance 52 which is located between the twist plate 41 and the horizontal surface 42 as a stopper. The abovementioned openings 14 of the pressure shaft 1, the pressure levers 22 and the spring plates 23 of the press bar 2, the penetrating holes of the cutter mounting 4 and the cutters 5 are all in a one-to-one relationship.

When assembling the cutter system of this invention, the cutters 5 are installed in the cutter mounting 4 and arranged by length in descending order from the middle of the cutter mounting 4 to each end of the cutter mounting 4. That is, the cutters 5 are arranged in the shape of an inverted 'V'. The cutters 5 are arranged in this manner for gradual operation of the cutters 5. The cutters 5 are also arranged so that inclined cutting edges 50 of adjacent cutters 5 are alternately inclined. Each pressure lever 22 is aligned with an opening 14 of the horizontal surface 11, and each lug member 15 is aligned with and inserted through an opening 32 of the L-shaped lever 3. A pin 16 is inserted through each lug member 15 to connect the pressure shaft 1 and the L-shaped lever 3.

The alternately inclined cutters allow for the distance from one initial cut to be different in spaced relation from a consecutively spaced initial cut. Thus, in this type of shearing action the forces in the plane of the paper or other material being cut will not be evenly transmitted to a next succeeding hole. The differing distance between the holes being cut allows for a lower stress on the paper in the plane of the paper between successive punched holes thereby providing a true "shear" cutting action which permits a more clean cutting of the paper. The spring plate 23 is coupled directly to the pressure lever 22 which allows for a smaller spring biasing force to reestablish the cutter system to an original position subsequent to cutting. As is known, when paper is cut, the cutters may jam in the sheaves of paper and cause the paper to be ripped when the cutters are removed.

In operation, pressure shaft 1 is pressed downwardly to cut paper or other materials with cutters 5. The elastic force of the spring plate 23 returns the pressure levers 22 to their original position. The horizontal surface 33 of the L-shaped lever 3 engages the protuberance 52 of cutters 5 to return the cutters 5 to their original position. For those cutters 5 that are not going to be used to cut paper, the corresponding pressure levers 22 can be removed from the press bar 2 in advance, thereby allowing the cutters 5 which will not be used to extend through the corresponding openings 14 in the horizontal surface 11 of the pressure shaft 1.

I claim:

1. An improved cutter system comprising:

(a) a pressure shaft having a horizontal surface, a first vertical surface intergrally attached to one edge of said horizontal surface, a second vertical surface integrally attached to said horizontal surface displaced from said first vertical surface, wherein said horizontal surface has a plurality of openings formed therethrough, said second vertical surface having a plurality of lug members extending rearwardly from a bottom edge, said pressure shaft further including a plurality of pressure levers fixedly connected to said first vertical surface;

(b) a press bar having said pressure levers extending through an upper end of a vertical surface of said press bar and a plurality of spring plates, wherein each of said spring plates has a first end fixedly attached to a mounting of said press bar and a second end engaged within a trough of a respective said pressure lever;

(c) a L-shaped lever having a horizontal surface and a vertical surface, wherein said vertical surface of said L-shaped lever has a plurality of openings passing therethrough for reception of said lug members of said pressure shaft;

(d) a cutter mounting including a twist plate having a plurality of opening passing therethrough, a vertical surface, and a horizontal surface having a plurality of through openings, wherein respective openings through said horizontal surface of said cutter mounting are aligned with said openings formed through said twist plate; and, (e) a plurality of cutters inserted through said openings of said twist plate and said horizontal surface of said cutter mounting, wherein each cutter has a protuberance located between said twist plate and said horizontal surface of said cutter mounting, said plurality of cutters each having an inclined cutting edge wherein inclined cutting edges of adjacent cutters are inclined in an opposing manner.

2. An improved cutter system as recited in claim 7 wherein said openings of said pressure shaft, said pressure levers and said spring plates of said press bar, said openings of said twist plate and of said horizontal surface of said cutter mounting, and said cutters are all in a one-to-one relationship.

* * * * *